US012723363B2

(12) United States Patent
Desborough et al.

(10) Patent No.: US 12,723,363 B2
(45) Date of Patent: Sep. 1, 2026

(54) SIDE GRIP VIBRATORY PILE DRIVER

(71) Applicant: Dawson Construction Plant Ltd, Milton Keynes (GB)

(72) Inventors: Stephen Desborough, Great Doddington (GB); David Brown, Towcester (GB)

(73) Assignee: DAWSON CONSTRUCTION PLANTLTD, Milton Keyes (GB)

( * ) Notice: Subject to any disclaimer, the term of this patent is extended or adjusted under 35 U.S.C. 154(b) by 39 days.

(21) Appl. No.: 18/859,239

(22) PCT Filed: Apr. 25, 2023

(86) PCT No.: PCT/GB2023/051096
§ 371 (c)(1),
(2) Date: Oct. 23, 2024

(87) PCT Pub. No.: WO2023/209362
PCT Pub. Date: Nov. 2, 2023

(65) Prior Publication Data

US 2025/0257540 A1 Aug. 14, 2025

(30) Foreign Application Priority Data

Apr. 26, 2022 (GB) ..... 2206027

(51) Int. Cl.
*E02D 7/18* (2006.01)

(52) U.S. Cl.
CPC ..... *E02D 7/18* (2013.01)

(58) Field of Classification Search
CPC ..... E02D 7/18; E02D 11/00
See application file for complete search history.

(56) References Cited

U.S. PATENT DOCUMENTS 4,100,974 A * 7/1978 Pepe ..... E02D 11/00 173/91
4,557,630 A 12/1985 Neil
(Continued)

FOREIGN PATENT DOCUMENTS

EP 2003252 12/2008
WO WO2013132138 9/2013

OTHER PUBLICATIONS

Barcessat, Lise; International Search Report; Jul. 26, 2023; 6 pages; HV, Rijswijk.

(Continued)

*Primary Examiner* — Benjamin F Fiorello
(74) *Attorney, Agent, or Firm* — STETINA GARRED BRUCKER & NEWBOLES

(57) ABSTRACT

A side grip pile driver for driving elongated objects into a ground surface comprising: a body for attaching the pile driver to a working machine; a first and second jaw members each jaw member having a clamping interface for clamping onto the side of an object to be driven; and a driving means arranged to move at least one of the jaw members, wherein each jaw member has a jaw arms and a gripping head, wherein the jaw arm is attached to the body and the gripping head, the gripping head providing the clamping interface, the jaw arm being attached to the gripping head via an elastomer member; wherein at least one of the gripping heads of the jaw members comprises a vibrator device for vibrating the gripping head such that the gripping head is couplable to the object in vibratory engagement.

20 Claims, 6 Drawing Sheets

(56) References Cited

U.S. PATENT DOCUMENTS

| | | | | | |
|---|---|---|---|---|---|
| 4,625,811 | A * | 12/1986 | Tuenkers | E02D 7/18 | 74/61 |
| 5,568,997 | A * | 10/1996 | Raunisto | E02D 7/26 | 405/303 |
| 9,765,496 | B2 * | 9/2017 | Lindeman | E02D 13/00 | |
| 10,294,624 | B2 * | 5/2019 | Audet | E02D 7/18 | |
| 2008/0310923 | A1 * | 12/2008 | Jinnings | E02D 11/00 | 405/232 |
| 2012/0001373 | A1 * | 1/2012 | Mclaughlin | F16F 1/403 | 267/141.1 |

OTHER PUBLICATIONS

Decker, Robert; Written Opinion; Jul. 26, 2023; 7 pages; HV, Rijswijk.
Monga, Navjot; Search and Examination Report; Sep. 28, 2022; 4 pages.

* cited by examiner

SIDE GRIP VIBRATORY PILE DRIVER

CROSS-REFERENCE TO RELATED APPLICATIONS

The present application claims priority to PCT International Patent Application No. PCT/GB2023/051096, filed Apr. 25, 2023, and Great Britain Patent Application No. 2206027.1 filed on Apr. 26, 2022, the disclosures of which are incorporated herein by reference.

STATEMENT RE: FEDERALLY SPONSORED RESEARCH/DEVELOPMENT

Not Applicable

BACKGROUND

This invention relates to a side grip vibratory pile driver.

Background of the Invention

Vibratory pile driving machines are common forms of piling equipment. These machines are typically attached to other working machines, such as a crane line or an excavator, and comprise a vibration device. The vibration device is typically hydraulically clamped to the pile to be driven or extracted and creates vibration by contra rotating eccentric weights. This vibration is transferred to the pile which causes the pile to be driven into or out of a ground surface.

One particularly advantageous type of vibratory pile driving machine is that which is arranged such that the vibration device clamps directly onto the pile from the side (rather than above the pile). Generally, this type of vibratory pile driving machine is able to better manipulate the pile and does not impart a height restriction that a traditional vibratory pile driving machine does. In traditional piling, the pile is required to be driven by a vibratory pile driving machine located above the pile. Therefore, the pile length is generally limited to the extent of the working machine that the vibratory pile driving machine is attached to. Further, in some arrangements, the vibrating element of the vibration device is clamped directly onto the side of the pile, which aligns driving forces of the vibrating machine with the pile resulting in greater pile driving performance.

In these types of side grip vibratory pile driving machines, the vibration device is typically attached to a static arm via a sliding or linear bearing. This allows clamping forces to be transferred to the vibration device, and thus the pile, whilst allowing the vibration device to move relative to the arm for suitable vibration. A problem with this arrangement is that the bearings are prone to premature mechanical failure due to the relatively large clamping and vibrating forces imparted on the bearings. This arrangement therefore lacks adequate durability, which costs time, money and effort to overcome.

The present invention aims to overcome or at least ameliorate one or more of the problems set out above.

BRIEF SUMMARY

Summary of the Invention

According to one aspect of the present invention, there is provided a side grip pile driver for driving elongated objects into a ground surface comprising: a body for attaching the pile driver to a working machine; a first and second jaw member moveably attached to the body, each jaw member having a clamping interface for clamping onto the side of an object to be driven; and a driving means arranged to move at least one of the jaw members relative to the body and each other for clamping the object between the clamping interfaces of the jaw members via a clamping force in a direction that is orthogonal to a longitudinal axis of the object, wherein each jaw member comprises: a jaw arm; and a gripping head, wherein the jaw arm is attached to the body and the gripping head, the gripping head providing the clamping interface, the jaw arm being attached to the gripping head via an elastomer member; wherein at least one of the gripping heads of the jaw members comprises a vibrator device for vibrating the gripping head such that the gripping head is couplable to the object in vibratory engagement to allow mutual vibration between the gripping head and the object in a direction that is parallel with a longitudinal axis of the object when the object is clamped between the clamping interfaces; and wherein the elastomer member is arranged to allow relative movement between the gripping head and the jaw arm in a direction that is parallel with a longitudinal axis of the object, whilst transferring the clamping force from the jaw arm to the gripping head.

In this way, mutual vibration between the gripping head and the object can occur for driving the object, whilst the object is simultaneously clamped by the gripping heads. This is achieved by the elastomer member allowing relative movement between the gripping head and the jaw arm, whilst transferring the clamping force from the jaw arm to the gripping head. This arrangement provides improved durability.

Preferably, the elastomer member comprises elastomer material mounted between a first and second end plate, the first end plate being connected to the jaw arm and the second end plate being connected to the gripping head. The elastomer material may comprise a generally cylindrical shape, the elastomer material being mounted between the first and second end plates at ends of the cylindrical shape.

Preferably, the elastomer member comprises an internal plate in the elastomer material for increasing the compressive load capacity of the elastomer member. The internal plate may be between the first and second end plate. In some arrangements, the elastomer member may comprise a second internal plate in the elastomer material. The end plates and the internal plates are preferably generally equidistance from one another. Preferably, the internal plate(s) are generally parallel with the first and second end plate. The internal plate(s) may have a generally circular shape, but other shapes in other arrangements. Preferably, the internal plate(s) are generally coaxial with the elastomer material.

Preferably, the elastomer material is arranged provide a reduction in shear stiffness when the material is compressed. Preferably, the elastomer material comprises rubber. Preferably, the rubber comprises vulcanized rubber.

In a preferable arrangement, the side grip pile driver further comprises a damping elastomer attached between the jaw arm and the gripping head such that the damping elastomer is orthogonal to the elastomer member. In some arrangements, the damping elastomer is the elastomer member, but is different in other arrangements.

Preferably, each gripping head comprises a plurality of elastomer members. The plurality of elastomer members may be arranged along a longitudinal axis of the gripping head. Preferably, the plurality of elastomer members are colinear.

Preferably, the plurality of elastomer members are arranged to transfer a total clamping force of between 240 kN and 1200 kN between the jaw arms and the gripping heads. Preferably, the plurality of elastomer members are arranged to provide a total shear stiffness of between 1250 N/mm and 10000 N/mm between the jaw arms and the gripping heads. Preferably, the elastomer member is arranged to deflect between 5 mm and 20 mm under a compressive load from the driving means.

In a preferable arrangement, both of the gripping heads of the jaw members comprise a vibrator device. The vibrator device(s) may be arranged such that the horizontal element of vibration is removed from the vibration generated from the vibrator device(s).

BRIEF DESCRIPTION OF THE DRAWINGS

Brief Description of the Drawings

Figure 1:
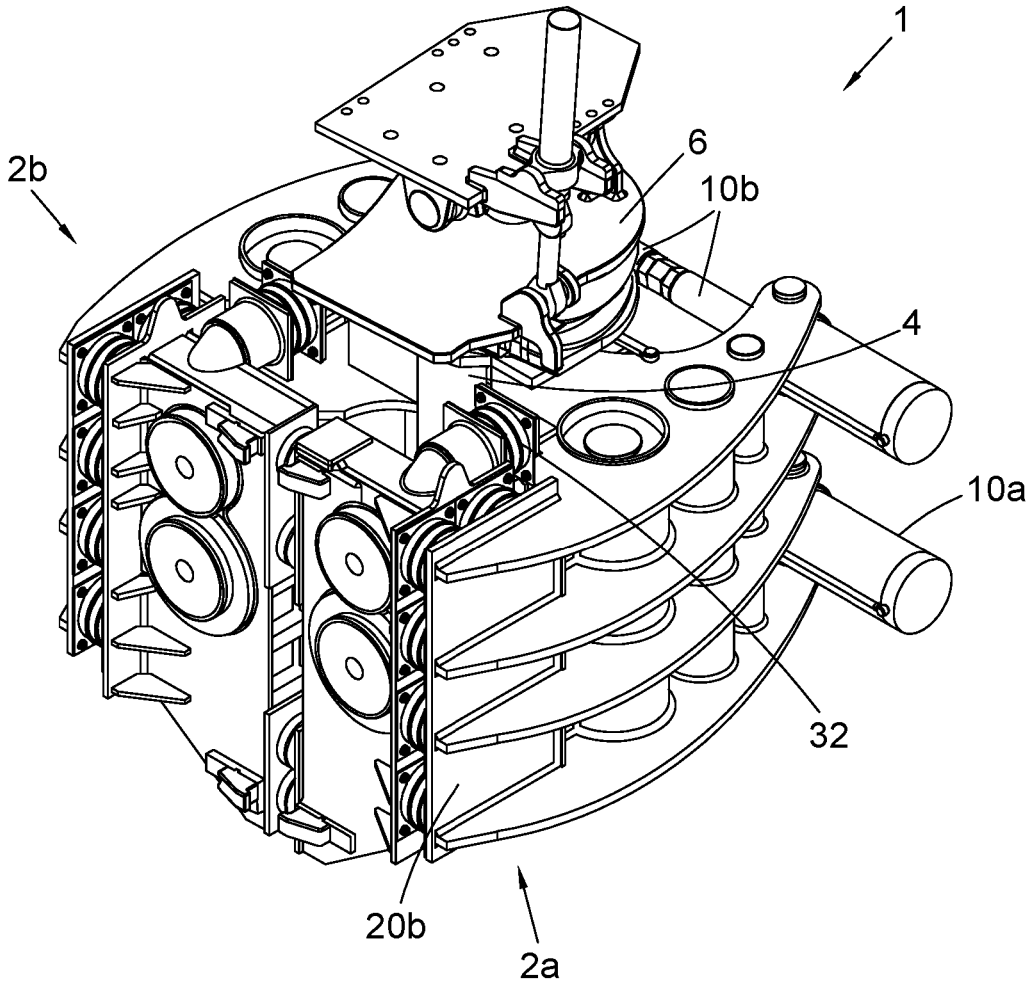

Embodiments of the invention will now be described by way of example, with reference to the drawings in which:

FIG. 1 is a perspective view of a first embodiment of the pile driver.

Figure 2:
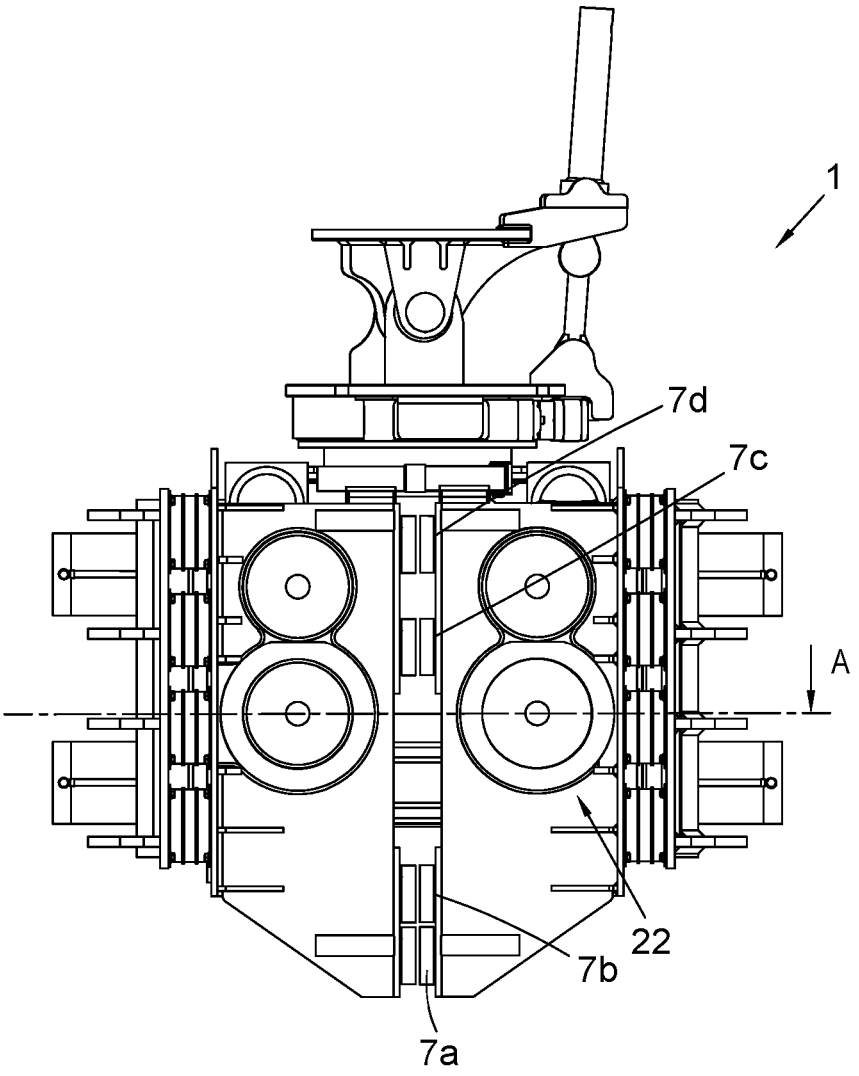

FIG. 2 is a front view of the pile driver of FIG. 1.

Figure 3:
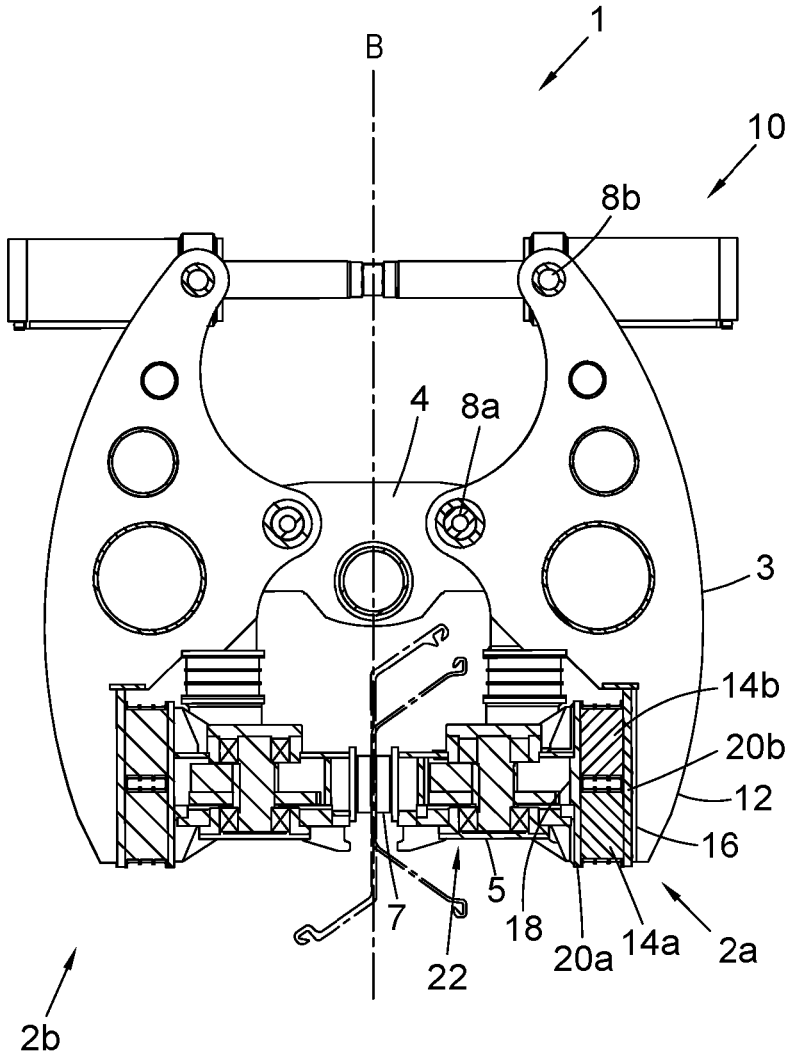

FIG. 3 is a cross-sectional view of the pile driver along the line AA in FIG. 2.

Figure 4A:
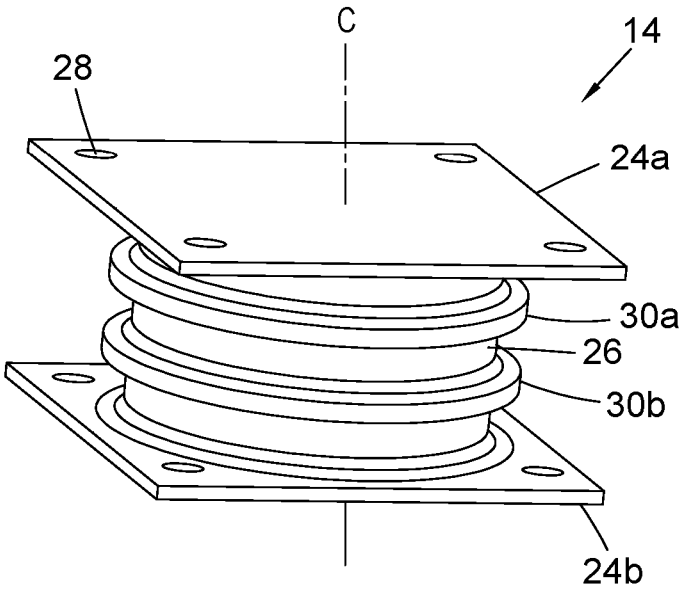

FIG. 4*a* is a perspective view of the elastomer mount.

Figure 4B:
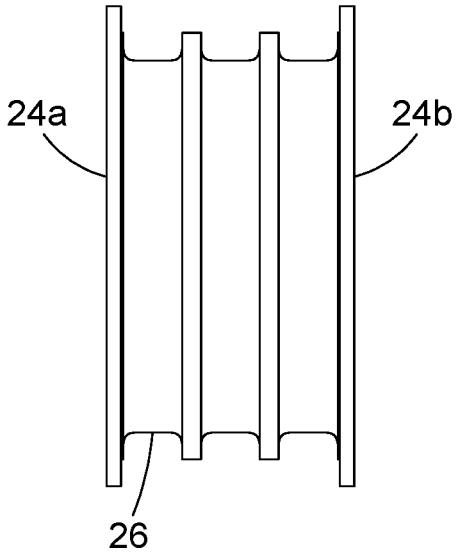

FIG. 4*b* is a side view of the elastomer mount of FIG. 4*a* rotated 90 degrees.

Figure 5:
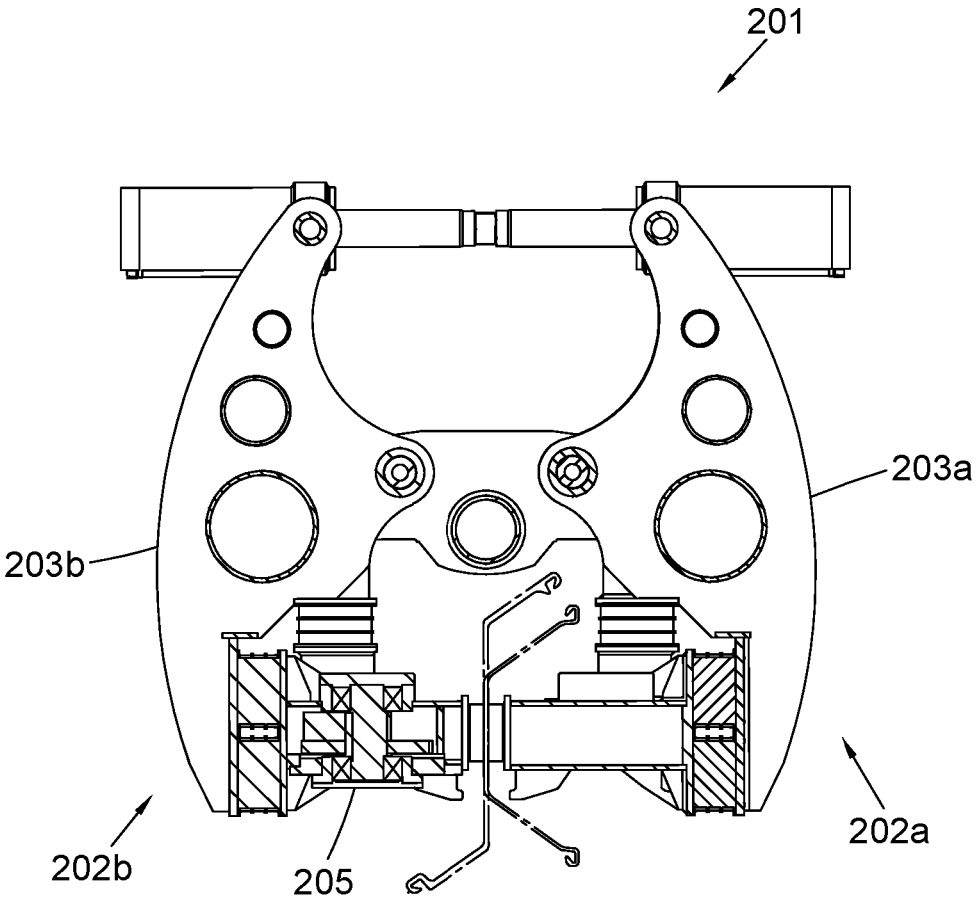
Figure 6A:
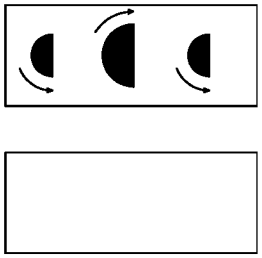
Figure 6B:
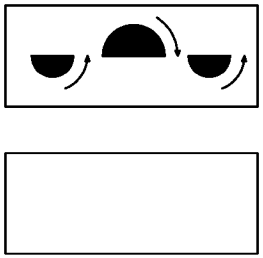
Figure 6C:
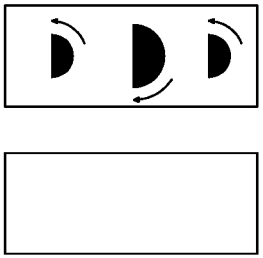
Figure 6D:
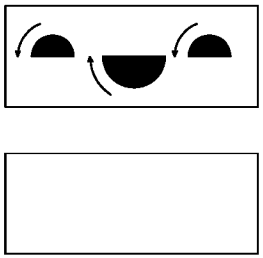

FIG. 5 is a perspective view of a second embodiment of the pile driver.

FIGS. 6*a* to 6*d* are cross-sectional views of the vibratory gearbox of the second embodiment of the pile driver showing the contra rotating cycle of the eccentric weights to remove unwanted horizontal components of vibration.

DETAILED DESCRIPTION

Detailed Description

In FIGS. 1, 2 and 3, a vibratory pile driver in accordance with a first embodiment of the present invention is shown as item 1. The pile driver 1 comprises a body 4. A pair of jaw members 2*a*, 2*b* are connected to the body 4 (best seen in FIG. 3). The body 4 comprises a horizontal mounting plate 6 for mounting the pile driver 1 to a working machine (not shown), such as a crane line or an excavator. In this way, the pile driver 1 can be moved and manipulated by a working machine to be positioned relative to the object for clamping. In some cases, the pile driver 1 may be mountable to a working machine in other suitable ways known to the skilled person.

The jaw members 2*a*, 2*b* are symmetrically arranged relative to each other, both horizontally and vertically, about the line B. In this embodiment, the jaw members 2*a*, 2*b* are structurally and functionally identical. Therefore, one jaw member 2*a* will be described. However, in other embodiments, the jaw members 2*a*, 2*b* may not be structurally and/or functionally identical to each other.

The jaw member 2*a* comprises an arcuate jaw arm 3 and a gripping head 5. A middle region of the jaw arm 3 is pivotally connected to the body 4 via pivot 8*a*, and an inner end of the jaw arm 3 is pivotally connected to a transversely extending hydraulic cylinder 10 via pivot 8*b*. The cylinder comprises a piston that is arranged to be moved within the cylinder. The cylinder can be operated to cause the jaw member 2*a* to move relative to the body 4, the cylinder 10 and the other jaw member 2*b*, via the pivots 8*a*, 8*b*. A distal end 12 of the jaw arm generally moves in an arc (due to pivots 8*a*, 8*b*) as the jaw member 2*a* is moved by the cylinder 10.

The cylinder of jaw member 2*b* can similarly be operated to move the jaw member 2*b* relative to the body 4, its cylinder and jaw member 2*a*, via its respective pivots. Thus, the cylinders are arranged to move or drive the jaw members 2*a*, 2*b* pivotally, towards one another or away from one another (depending on the direction the pistons within the cylinders are moved).

The gripping head 5 comprises a vertical gripping pad 7 connected to an outer face of the gripping head 5 that faces the gripping head of the jaw member 2*b*. The gripping pad 7 provides a contact or clamping interface for contacting or clamping onto the side of an object to be driven by the pile driver. The object to be driven typically comprises an elongated structure, such as a pile. A region or distance between the gripping pad 7 and the gripping pad of the jaw member 2*b* defines a clamping zone for clamping an object to be driven between the gripping pads of the gripping heads of the jaw members 2*a*, 2*b*.

To clamp an object between the gripping pads, the cylinders are operated to drive the gripping heads of the jaw members 2*a*, 2*b* away from each other (i.e., to increase a distance between the gripping pads of the gripping heads to provide clearance for the object). The object to be driven is then placed between the gripping pads (i.e., in the clamping zone), or the gripping heads are brought either side of the object. The cylinders are then operated to drive the gripping heads together until the gripping pads contact and clamp the object therebetween via the sides of the object—each gripping pad contacts and clamps a side of the object. A lateral clamping force is thus imparted on the object from the cylinders via the jaw arms, the gripping heads and ultimately the gripping pads. The clamping force imparted on the object is thus orthogonal to a longitudinal axis of the object.

As illustrated in FIG. 3, the cylinders of the jaw members 2*a*, 2*b* are rigidly connected together at inner ends of the cylinders. A controller is arranged to control operation of the cylinders. In this embodiment, operation of the cylinders is synchronized such that each of the pistons within the cylinders moves in tandem with the other and with the same magnitude of force. In this way, the jaw members 2*a*, 2*b* are moved simultaneously relative to one another, and the same clamping force is imparted on the object by each cylinder. In some cases, the cylinders may alternatively or additionally be independently operated. In this way, the clamping force generated from each cylinder can be independently varied. In other embodiments, one of the jaw members 2*a*, 2*b* may be static (for example, does not comprise cylinders for moving the member) and the other jaw member is moved (via cylinders) relative to the static jaw member to clamp the object.

The cylinders of the jaw arms illustrated in FIG. 3 are located at a lower region or end of the pile driver 1. The pile driver 1 comprises a further pair of cylinders 10*b* in an upper region or end of the pile driver 1 (best seen in FIG. 1). These upper cylinders 10*b* are connected, and function, in the same way as the pair of cylinders 10*a* in the lower region of the pile driver 1. Both pairs of cylinders 10*a*, 10*b* are vertically aligned. Further, as illustrated in FIG. 2, each gripping head of the jaw members 2*a*, 2*b* comprises four gripping pads 7*a*, 7*b*, 7*c*, 7*d* that are vertically aligned on the outer surface of the gripping head. In this way, the gripping head 5 provides several contact points for clamping the object that are spaced along a vertical length of the gripping head 5. This, in combination with the spatial arrangement of the pairs of cylinders 10*a*, 10*b*, allows the object to be more securely clamped by the gripping heads, by distributing the clamping forces from the cylinders over a larger surface area and length of the object. In some cases, there may be only a single pair of cylinders, or a single cylinder that drives both jaw arms of the jaw members 2*a*, 2*b*. In other cases, there may be more than two pairs of cylinders, depending on the overall clamping force required.

The gripping head 5 is connected to the distal end 12 of the jaw arm 3 via a pair of transversely arranged elastomer mounts 14*a*, 14*b* that are horizontally aligned (i.e., next to each other). The elastomer mounts 14*a*, 14*b* are transversely connected between an inner face 16 of the jaw arm 3 and an outer face 18 of the gripping head 5 via respective vertical mounting plates 20*a*, 20*b*. In this way, the elastomer mounts are arranged to transfer clamping forces applied by the cylinder 10 to the gripping head 5. This is because, when the cylinder 10 is actuated for clamping an object, the inner face 16 of the jaw arm 3 (seen in FIG. 3) is driven towards the outer face 18 of the gripping head 5. The elastomer mount is thus compressed (along a longitudinal length of the elastomer mount), allowing the clamping force to be transferred to the gripping head 5. In this way, most, if not all, of the clamping force from the cylinder 10 is transferred to the gripping head 5. Preferably, at least 2% of the clamping force applied by the cylinders is transferred to the gripping heads via the elastomer mounts of the pile driver 1. More preferably, 95% to 100% of the clamping force applied by the cylinders is transferred to the gripping heads via the elastomer mounts of the pile driver 1.

The elastomer mounts are also arranged to allow relative movement between the gripping head 5 and the jaw arm 3 whilst transferring the clamping force from the cylinder 10, which will be described later on.

The gripping head 5 comprises a vibratory gearbox 22 for vibrating the gripping head 5. The vibratory gearbox 22 comprises a pair of vertically aligned eccentric weights that are arranged to be rotated in opposite directions to create vibration or impacts, as the skilled person will understand. In this way, the vibratory gearbox 22 is arranged to create vibration or impacts in a vertical direction (i.e., the gearbox 22 moves up and down along a vertical plane). The vertical vibrating or impact force created by the gearbox 22 is thus orthogonal to the transverse direction of the clamping force imparted on the object by the gripping head 5.

When the gripping heads of the jaw members 2*a*, 2*b* are clamped onto an object, the vibratory gearbox of each gripping head is axially aligned with the object. This allows effective mutual vibration between the object and the gearboxes (via the gripping heads and gripping pads) because the gearboxes are proximate to and axially aligned with the object being driven. In other words, the gripping head 5 is couplable to the object in vibratory engagement to allow mutual vibration between the gripping head 5 and the object when the object is clamped between the clamping interfaces of the jaw members 2*a*, 2*b*.

The elastomer mounts 14*a*, 14*b* will now be described. In this embodiment, each elastomer mount is structurally and functionally identical. Therefore, one elastomer mount will be described. However, in other embodiments, each elastomer mount may not be structurally and/or functionally identical to each other.

As illustrated in FIGS. 4*a* and 4*b*, the elastomer mount 14 comprises a generally cylindrical elastomer material 26 that is mounted between a pair of rectangular end plates 24*a*, 24*b* at each end of the elastomer material 26. Each end plate comprises mounting holes 28 in the corners of each plate for mounting the elastomer mount 26 to the mounting plates 20*a*, 20*b* (seen in FIG. 3).

The elastomer material 26 comprises first and second internal plates 30*a*, 30*b* between the end plates 24*a*, 24*b*. The internal plates 30*a*, 30*b* have a generally cylindrical shape and are arranged within the elastomer such that a circumferential rim is formed on an exterior surface of the elastomer material by each plate 30*a*, 30*b*.

In this embodiment, the elastomer material 26 comprises two internal plates that are parallel with the end plates 24*a*, 24*b*—the plates 24*a*, 24*b*, 30*a*, 30*b* are generally equidistance. Further, the internal plates 30*a*, 30*b* are coaxial with the elastomer material 26. In some cases, the elastomer material 26 may comprise a single internal plate or more than two internal plates, depending on the compressive load capacity required of the elastomer mount 14. Further, in some cases, the internal plates may not be parallel with the end plates, the plates 24*a*, 24*b*, 30*a*, 30*b* may not be equidistant, and the internal plates 30*a*, 30*b* may not be coaxial with the elastomer material 26.

The elastomer material comprises a rubber compound, such as vulcanized rubber. Therefore, when the elastomer mount is compressed (i.e., via the clamping force) longitudinally (i.e., along the longitudinal axis C in FIG. 4*a*), the shear stiffness of the elastomer material 26 reduces depending on the magnitude of the compressive load applied to the elastomer material 26. This allows the elastomer mount 14 to have a shear stiffness that is suitably low to allow vertical relative movement between the gripping head and the jaw arm for effective vibration of the object, but a suitably high compressive capability to effectively transfer the clamping forces from the cylinders to the gripping heads 5 such that the object is securely clamped during vibration.

In this regard, when a compressive load (within an operational range of the pile driver 1) is applied to the elastomer mount 14, the shear stiffness of the elastomer mount is reduced to about half (compared to its shear stiffness when no compressive load is applied to the elastomer mount). For example, if the elastomer mount 14 comprises a shear stiffness of 360 N/mm when no compressive or shear load is applied to the elastomer mount 14, an applied compressive load of 100 KN and a shear load of 90 mm reduces the shear stiffness of the elastomer mount 14 to 180 N/mm.

Preferably, when a compressive load (within an operational range of the pile driver 1) is applied to the elastomer mount 14, the elastomer mount is arranged to have a shear stiffness of between 80 N/mm and 220 N/mm. Preferably, the compressive stiffness of the elastomer mount is between 3300 to 5000 N/mm. Preferably, the elastomer mount has a ratio of compressive stiffness to shear stiffness under a compressive load of between 22.7 and 41.25. Preferably, the elastomer mount 14 is arranged to be displaced up to 20 mm when a compressive load (within an operational range of the pile driver 1) is applied to the elastomer mount 14.

For a given overall compressive load applicable by the cylinder 10, the amount of compressive load applied to each elastomer mount of the jaw member 2*a* depends on the total number of elastomer mounts provided by the jaw member 2*a*. This is because the applied compressive load of the cylinder 10 is distributed evenly between all of the elastomer mounts that are mounted between the jaw arm 3 and gripping head 5. In the embodiment illustrated by FIGS. 1 to 3, each gripping head comprises four vertically aligned pairs of elastomer mounts. Therefore, the jaw members 2*a*, 2*b* each comprise eight elastomer mounts. So, for an overall compressive load of 1200 kN (applicable by the cylinders of the pile driver 1), a compressive load of 75 kN is applied to each elastomer mount. Each elastomer mount thus transfers 75 kN of clamping force from the cylinders to its respective gripping head.

In another embodiment, each gripping head comprises five vertically aligned elastomer mounts. In this case, for the overall compressive load of 1200 kN (applicable by the cylinders of the pile driver 1), a compressive load of 120 kN is applied to each elastomer mount. Each elastomer mount thus transfers 120 kN of clamping force from the cylinders to its respective gripping head.

The number of elastomer mounts the gripping heads comprise will depend on the amount of clamping force that is required (for clamping the object), and the amount of vibrational or centrifugal force required (for driving the object). The amount of clamping force and vibrational or centrifugal force depends on the size of the pile driver 1 and the loads required for its intended application. Preferably, the overall clamping or compressive force provided by the cylinders is 1.2 times the centrifugal force provided by the vibratory gear boxes. Preferably, the overall vibrational or centrifugal force provided by the vibratory gear boxes is between 200 kN and 1000 kN, and the overall clamping or compressive force provided by the cylinders (i.e., the operational range of the pile driver 1) is between 240 kN and 1200 kN.

The internal plates 30*a*, 30*b* increase the compressive load capacity of the elastomer mount 14. In this regard, the internal plates 30*a*, 30*b* comprise a higher strength steel material, such as a 4140 steel. In this way, each internal plate has a minimum yield strength of 490 MPa. The end plates comprise a steel material having a minimum yield strength of 350 MPa, such as 350 Grade Mild steel. The minimum yield strength of the internal plates and the end plates will depend on the size of the pile driver 1 (and thus will depend on the compressive load required for its intended application).

The gripping head 5 also comprises a pair of vertically aligned steering elastomers 32 (only one of which is visible in FIG. 1). The steering elastomers are mounted between the jaw arm 3 and gripping head 5 such that the steering elastomers are orthogonal to the elastomer mounts. The steering elastomers do not transfer clamping forces from the cylinders, but instead transfer and dampen loads induced from the working machine (such as those created from manipulating the orientation of the pile driver 1). Such forces (i.e., from the working machine) may be around 50 kN overall. Thus, the four steering elastomers are arranged to transfer 12.5 kN each. In this embodiment, the steering elastomers are the same, structurally, as the elastomer mounts. In other cases, the steering elastomers may have a different structure to that of the elastomer mounts. Further, in other embodiments, each jaw member may comprise more or less than two steering elastomers. Preferably, the steering elastomer is arranged to be displaced up to 10 mm when a compressive load is applied to the steering elastomer from the working machine.

In this embodiment, the elastomer mounts of both gripping heads, in combination with the steering elastomers, provide the pile driver 1 with an overall shear stiffness of 2500 N/mm. The overall shear stiffness of the pile driver 1 (i.e., provided by the elastomer mounts and steering elastomers) depends on the size of the pile driver 1 (and thus will depend on the compressive load and shear stiffness required for its intended application). Preferably, the elastomer mounts and steering elastomers provide the pile driver 1 with an overall shear stiffness of between 1250 N/mm and 10,000 N/mm. For example, a relatively small size pile driver may comprise an overall shear stiffness of between 1250 N/mm and 2500 N/mm, a relatively medium size pile driver may comprise an overall shear stiffness of between 2500 N/mm and 5000 N/mm, and a relatively large pile driver may comprise an overall shear stiffness of between 5000 N/mm and 10,000 N/mm.

FIG. 5 illustrates a second embodiment of the present invention. This embodiment is structurally and functionally identical to the first embodiment described above, but differs in that only one of the jaw members 203*a*, 203*b* of the pile driver 201 comprises a vibratory gearbox 222. In FIG. 5, the vibratory gearbox 222 is provided by the gripping head 205 of the jaw arm 202*b*—the jaw arm 202*a* does not comprise a vibratory gear box.

In the first embodiment described above, the vibratory gear boxes of each jaw member are arranged such that the contra rotating eccentric weights cancel out unwanted horizontal components of vibration between the gearboxes of each jaw arm. As illustrated in FIGS. 6*a* to 6*d*, the vibratory gear box 222 differs from this arrangement in that it utilizes a larger eccentric weight and two smaller contra rotating eccentric weights (above and below the larger weight) to cancel out (or remove or significantly attenuate) the horizontal component of vibration that is generated by the gear box 222 (i.e., from the same gear box). The horizontal component of vibration generated by the gear box is undesirable.

The invention claimed is:

1. A side grip pile driver for driving elongated objects into a ground surface comprising:

a body for attaching the pile driver to a working machine;

a first and second jaw member moveably attached to the body, each jaw member having a clamping interface for clamping onto the side of an object to be driven; and a driving means arranged to move at least one of the jaw members relative to the body and each other for clamping the object between the clamping interfaces of the jaw members via a clamping force in a direction that is orthogonal to a longitudinal axis of the object, wherein each jaw member comprises:

a jaw arm; and a gripping head, wherein the jaw arm is attached to the body and the gripping head, the gripping head providing the clamping interface, the jaw arm being attached to the gripping head via an elastomer member;

wherein at least one of the gripping heads of the jaw members comprises a vibrator device for vibrating the gripping head such that the gripping head is couplable to the object in vibratory engagement to allow mutual vibration between the gripping head and the object in a direction that is parallel with a longitudinal axis of the object when the object is clamped between the clamping interfaces; and wherein the elastomer member is arranged to allow relative movement between the gripping head and the jaw arm in a direction that is parallel with a longitudinal axis of the object, whilst transferring the clamping force from the jaw arm to the gripping head.

2. The side grip pile driver according to claim 1, wherein the elastomer member comprises elastomer material mounted between a first and second end plate, the first end plate being connected to the jaw arm and the second end plate being connected to the gripping head.

3. The side grip pile driver according to claim 2, wherein the elastomer material comprises a generally cylindrical shape, the elastomer material being mounted between the first and second end plates at ends of the cylindrical shape.

4. The side grip pile driver according to claim 2, wherein the elastomer member comprises an internal plate in the elastomer material for increasing the compressive load capacity of the elastomer member.

5. The side grip pile driver according to claim 4, wherein the internal plate is between the first and second end plate.

6. The side grip pile driver according to claim 4, wherein the elastomer member comprises a second internal plate in the elastomer material.

7. The side grip pile driver according to claim 6, wherein the first and second end plates and the first and second internal plates are generally equidistance from one another.

8. The side grip pile driver according to claim 4, wherein the internal plate is generally parallel with the first and second end plate.

9. The side grip pile driver according to claim 4, wherein the internal plate has a generally circular shape.

10. The side grip pile driver according to claim 9, wherein the internal plate is generally coaxial with the elastomer material.

11. The side grip pile driver according to claim 2, wherein the elastomer material is arranged provide a reduction in shear stiffness when the material is compressed.

12. The side grip pile driver according to claim 1, further comprising a damping elastomer attached between the jaw arm and the gripping head such that the damping elastomer is orthogonal to the elastomer member.

13. The side grip pile driver according to claim 12, wherein the damping elastomer is an elastomer member.

14. The side grip pile driver according to claim 1, wherein each gripping head comprises a plurality of elastomer members.

15. The side grip pile driver according to claim 14, wherein the plurality of elastomer members are arranged along a longitudinal axis of the gripping head.

16. The side grip pile driver according to claim 14, wherein the plurality of elastomer members are arranged to transfer a total clamping force of between 240 kN and 1200 kN between the jaw arms and the gripping heads.

17. The side grip pile driver according to claim 1, wherein the plurality of elastomer members are arranged to provide a total shear stiffness of between 1250 N/mm and 10000 N/mm between the jaw arms and the gripping heads.

18. The side grip pile driver according to claim 1, wherein the elastomer member is arranged to deflect between 5 mm and 20 mm under a compressive load from the driving means.

19. The side grip pile driver according to claim 1, wherein both of the gripping heads of the jaw members comprise a vibrator device.

20. The side grip pile driver according to claim 1, wherein the vibrator device is arranged such that the horizontal element of vibration is removed from the vibration generated from the vibrator device(s).

* * * * *